US010202175B2

(12) United States Patent
Autelli

(10) Patent No.: US 10,202,175 B2
(45) Date of Patent: Feb. 12, 2019

(54) APPARATUS FOR TRANSFERRING PEOPLE AND/OR GOODS TO OR FROM A VESSEL

(71) Applicant: Francesco Autelli, Genoa (IT)

(72) Inventor: Francesco Autelli, Genoa (IT)

( * ) Notice: Subject to any disclaimer, the term of this patent is extended or adjusted under 35 U.S.C. 154(b) by 0 days.

(21) Appl. No.: 14/896,320

(22) PCT Filed: Jun. 7, 2013

(86) PCT No.: PCT/IT2013/000160

§ 371 (c)(1),
(2) Date: Dec. 4, 2015

(87) PCT Pub. No.: WO2014/195979

PCT Pub. Date: Dec. 11, 2014

(65) Prior Publication Data

US 2016/0121975 A1 May 5, 2016

(51) Int. Cl.

| | |
|---|---|
| ***B63B 27/10*** | (2006.01) |
| ***B66C 13/02*** | (2006.01) |
| ***B66C 1/66*** | (2006.01) |
| ***B63B 27/14*** | (2006.01) |
| ***B63B 27/36*** | (2006.01) |

(52) U.S. Cl.

CPC ..... *B63B 27/10* (2013.01); *B63B 27/14* (2013.01); *B63B 27/143* (2013.01); *B63B 27/36* (2013.01); *B63B 2027/141* (2013.01)

(58) Field of Classification Search

CPC . B63B 27/30; B63B 2017/0072; B63B 27/14; B63B 27/10; B63B 27/143; B63B 2027/141; B63B 27/36; B63B 39/00; B66C 13/02; B66C 23/08; B66F 11/044; B66F 11/046; E01D 19/106; E21D 11/40

USPC ..... 114/259, 343, 362, 369; 14/71.3, 71.7; 182/2.3, 2.8, 2.9, 69.4, 69.6; 254/2 C, 254/9 C; 298/22 J; 414/10–12, 138.2, (Continued)

(56) References Cited

U.S. PATENT DOCUMENTS 3,409,158 A * 11/1968 Lull ..... B66F 9/127 414/11
4,367,532 A * 1/1983 Crum ..... B05B 13/0431 318/568.13

(Continued)

FOREIGN PATENT DOCUMENTS

| | | |
|---|---|---|
| EP | 1382523 | 1/2004 |
| FR | 2862275 | 5/2005 |

(Continued)

OTHER PUBLICATIONS

World Intellectual Property Organization, International Search Report for International Application No: PCT/IT2013/000160, dated Feb. 21, 2014, pp. 1-3.

*Primary Examiner* — Gregory W Adams
(74) *Attorney, Agent, or Firm* — SoCAL IP Law Group LLP; Mark Andrew Goldstein

(57) ABSTRACT

Apparatus for transferring people and/or goods to or from a vessel (10), comprising a movable platform (1) connected to a movement assembly (4;2), said movement assembly (4;2) being arranged on a support base (3) which is coupled to said vessel (10), said platform (1) being maintained at an inclination substantially parallel to the water line of the vessel (10) by suitable means (301, 301'; 214, 334; 722, 822), the position of said platform (1) being able to be adjusted and controlled.

9 Claims, 7 Drawing Sheets

(58) Field of Classification Search
USPC ..... 414/138.3, 138.8, 139.5, 139.6, 139.7, 414/495, 589, 590, 728, 743
See application file for complete search history.

(56) References Cited

U.S. PATENT DOCUMENTS

| | | | | |
|---|---|---|---|---|
| 4,537,533 | A * | 8/1985 | Hampton | B63B 21/50 405/205 |
| 4,682,926 | A * | 7/1987 | Chambers | E04F 21/1816 254/2 C |
| 4,854,800 | A * | 8/1989 | Frick | B63B 27/10 414/137.9 |
| 5,253,606 | A * | 10/1993 | Ortelli | B66C 13/02 114/259 |
| 6,024,145 | A * | 2/2000 | Ackles | A01G 23/08 144/336 |
| 6,659,703 | B1 * | 12/2003 | Kirkley | B63B 27/10 414/138.2 |
| 6,698,371 | B1 * | 3/2004 | Stoltzfus | B63B 35/58 114/61.1 |
| 6,955,134 | B2 * | 10/2005 | Prins | B63B 21/00 114/230.14 |
| 6,955,519 | B1 | 10/2005 | Ferderber | |
| 7,103,935 | B2 * | 9/2006 | Hill | B63L 327/143 114/362 |
| 8,056,674 | B2 * | 11/2011 | Bean | B66F 11/046 182/18 |
| 8,187,045 | B2 * | 5/2012 | Thibodaux | B63L 327/06 440/37 |
| 9,162,736 | B2 * | 10/2015 | Thibodaux | B63B 27/06 |
| 2010/0032543 | A1 * | 2/2010 | Van Der Tempel | B63B 17/00 248/550 |
| 2010/0089302 | A1 | 4/2010 | Muller | |
| 2010/0170747 | A1 * | 7/2010 | Crook | B66F 11/046 182/2.2 |
| 2011/0038691 | A1 * | 2/2011 | Leske | B25J 11/00 414/139.5 |
| 2011/0063121 | A1 * | 3/2011 | Le Devehat | B63B 27/24 340/669 |
| 2011/0066278 | A1 * | 3/2011 | Pinault | A61N 5/1049 700/213 |
| 2012/0010747 | A1 * | 1/2012 | Okazaki | G05B 19/423 700/253 |
| 2012/0207549 | A1 * | 8/2012 | Wegener | E02D 5/04 405/184.4 |

FOREIGN PATENT DOCUMENTS

| | | |
|---|---|---|
| WO | 2009084046 | 7/2009 |
| WO | 2012121645 | 9/2012 |

* cited by examiner

APPARATUS FOR TRANSFERRING PEOPLE AND/OR GOODS TO OR FROM A VESSEL

FIELD OF THE INVENTION

This application is a National Stage Application filed under 35 U.S.C. 371 and claims the benefit of priority to Patent Cooperation Treaty Application No. PCT/IT2013/000160 filed Jun. 7, 2013, the full contents of which are incorporated herein by reference.

STATE OF THE ART OF THE INVENTION

The problem of transferring goods and/or personnel to or from a water-borne structure has always been very significant, and it has been addressed in the most various ways. Systems for moving people and/or goods have been known which are mainly intended for use on the open sea, particularly for supplying offshore platforms, such as those described in documents EP614432, WO2004/108519, WO2010/034429 and WO2011/091854, for example. These systems generally require organized facilities both on-shore and on-board as well as very complex loading and unloading procedures.

In other cases, systems have been designed which are mainly intended for transferring people with limited mobility, particularly along with their wheelchairs, such as disclosed in documents JP2005161952, EP2130757 and WO99/025301, for example. This type of approach, which is usually intended to move a platform designed to carry the wheelchair, is generally quite bulky and very poorly suited to a mixed use, i.e. also intended for the transportation of goods.

Finally, there have been known various types of movable and/or retractable gangplanks such as those described, for example, in documents WO2006/120593 and WO2009/125439. However, these devices are not useful for the transportation of items, and people using them should be able to move across a structure with a small surface area and a very limited stability.

Therefore, the aim of the present invention is to provide an apparatus for transferring able-bodied and disabled people as well as goods to or from a vessel, which is improved in stability, easy to be operated, versatile in use and provided with a high operational safety level.

Another aim of said apparatus is to circumvent the use of gangplanks or other similar equipment, which are permanently connected between the vessel and the relevant landing pier or otherwise rigidly adjacent thereto.

A further aim of the invention is to provide an apparatus which is easy to be installed on board a vessel, preferably an apparatus relatively small in overall size with respect to its operational abilities.

OBJECT OF THE INVENTION

Accordingly, the object of the present invention is an apparatus for transferring people and/or goods to or from a vessel, comprising a platform connected to a movement assembly, said movement assembly being arranged on a support base which is coupled to said vessel, said platform being maintained at an inclination which is substantially parallel to the water line of said vessel.

In one embodiment, said support base is coupled to said vessel and arranged parallel with respect to the planes of the decks of said vessel, and preferably it protrudes in cantilever fashion from the transom of said vessel in an at least partially retractable manner.

Additionally, said apparatus can be designed so as to be entirely contained, when in a non-operating condition, within a special housing which opens to said transom of the vessel, the housing being able to be opened and closed.

However, the present apparatus may be alternatively installed in another place of the vessel, it may also be incorporated into the structure of one of the decks if needed, and it may also be suitably shaped and coated to provide a pleasant aesthetic appeal.

Advantageously, said platform is connected to said movement assembly by means of pivoting devices, and there are provided suitable means for operating and controlling the pivotal movement of said pivoting devices. Also provided are inclination sensors which are suitable for detecting the position of said platform and maintaining it in a substantially horizontal condition.

In a further embodiment, said movement assembly is arranged on said support base in such a way as to rotate by 360° about an axis which is perpendicular to said base, the movement assembly being provided with suitable drive means. Similarly, said platform is mounted on said movement assembly in such a way as to rotate about an axis which is perpendicular to said platform. Particularly, said platform can be mounted on a movable carriage along a direction parallel to the plane of said platform, the carriage being in turn rotatably coupled to said movement assembly.

In one embodiment, said movement assembly includes an articulated arm comprising at least two segments which can pivot with respect to each other and with respect to both said support base and said platform, there being provided suitable drive means. Particularly, said articulated arm is a robotic arm comprising at least two articulated arms and a wrist which is pivotally connected to the free end of one of said two segments, the end portion of said wrist being rigidly connected either to the movable carriage having mounted thereon the platform or to the platform itself, if the movable carriage is not provided.

In another embodiment, said movement assembly comprises at least one articulated parallelogram structure. Particularly, said structure comprises at least two arms arranged parallel to each other and rotatably pivoted to two box-like bodies, there being provided drive means for rotating said arms with respect to an axis perpendicular to their common plane, a first box-like body being connected to said support base and a second box-like body being connected to said platform. Preferably, said assembly comprises two pairs of arms which are arranged on parallel planes and pivotally connected to the two box-like bodies. Particularly, said arms are pistons, for example of hydraulic type.

The drive means and the sensor means are advantageously interfaced with a central control unit which allows the operation of the apparatus to be coordinated; the central control unit is provided with a user interface which allows both manual and preset controls to be executed. Furthermore, there can be provided sensors arranged on the platform to detect the relative position of the platform with respect to the locations in which the platform is desired to be accessed, so as to improve the adjustment of the position thereof; these sensors are interfaced with said central control unit.

BRIEF DESCRIPTION OF THE DRAWINGS

The apparatus according to the present invention and its operation will be apparent from the following detailed description of two embodiments thereof, which are provided by way of a non-limiting example with reference to the accompanying drawings, where.

DESCRIPTION OF CERTAIN EMBODIMENTS OF THE INVENTION

Figure 1:
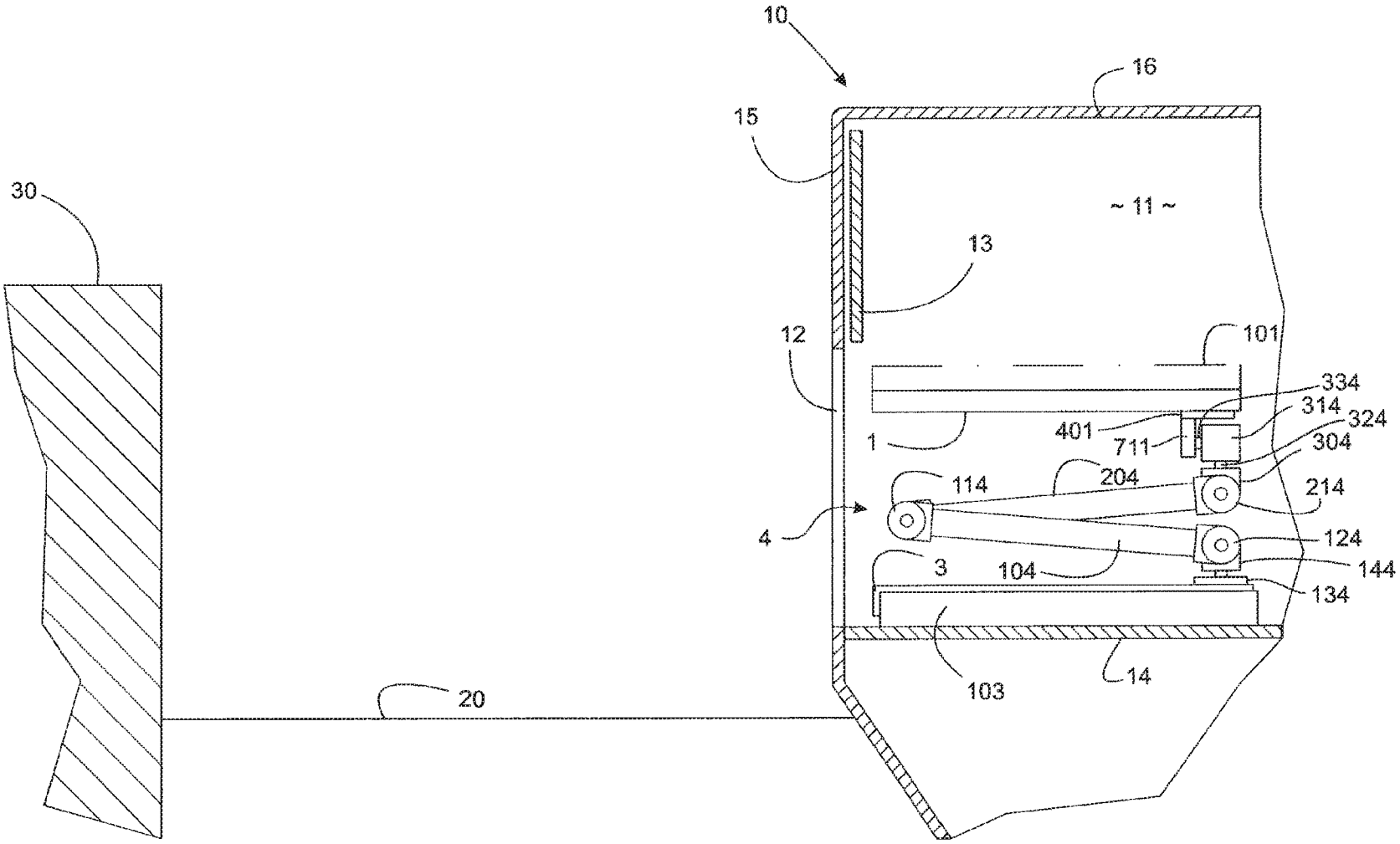
FIG. 1 is a side elevation view of a first embodiment of the apparatus according to the present invention when in a non-operating configuration.

In FIG. 1 there is illustrated a first embodiment of the apparatus according to the present invention. The apparatus is illustrated in a non-operating configuration, and it is arranged within an aft compartment 11 located beneath an upper deck 16 and provided with an opening 12 which is formed in a transom 15 and equipped with a movable door 13. A guide 103 adapted to movably and slidably receive a support base 3 is located on a deck 14 of the compartment 11. In the embodiment described herein, the movement assembly is a robotic arm 4 which comprises two articulated segments 104 and 204; one end of the segment 104 is connected to the support base 3 by means of a foot 134 and a block 144 pivotally mounted to said foot 134. The end of the segment 104 which is connected to the block 144 is provided with drive means 124.

The other end of the segment 104 is provided with drive means 114 and coupled to the segment 204 which, at the opposite end, is connected to a wrist 304 by drive means 214, the end 314 of the wrist being provided with two rotational shafts which are perpendicular to each other. Particularly, the shaft 324 allows the platform 1 to be rotated with respect to the robotic arm 4 along an axis perpendicular to the mean water line, while the shaft 334, which is coupled to a bracket 711 rigidly coupled to a carriage 401, as better illustrated in section in FIG. 6 hereinbelow, and movable within the platform 1, allows said platform to be rotated transversally to the vessel, along an axis parallel to the mean water line.

The platform 1 can be provided with a movable shoulder 101, in this case illustrated in a retracted condition by chain lines.

Figure 2:
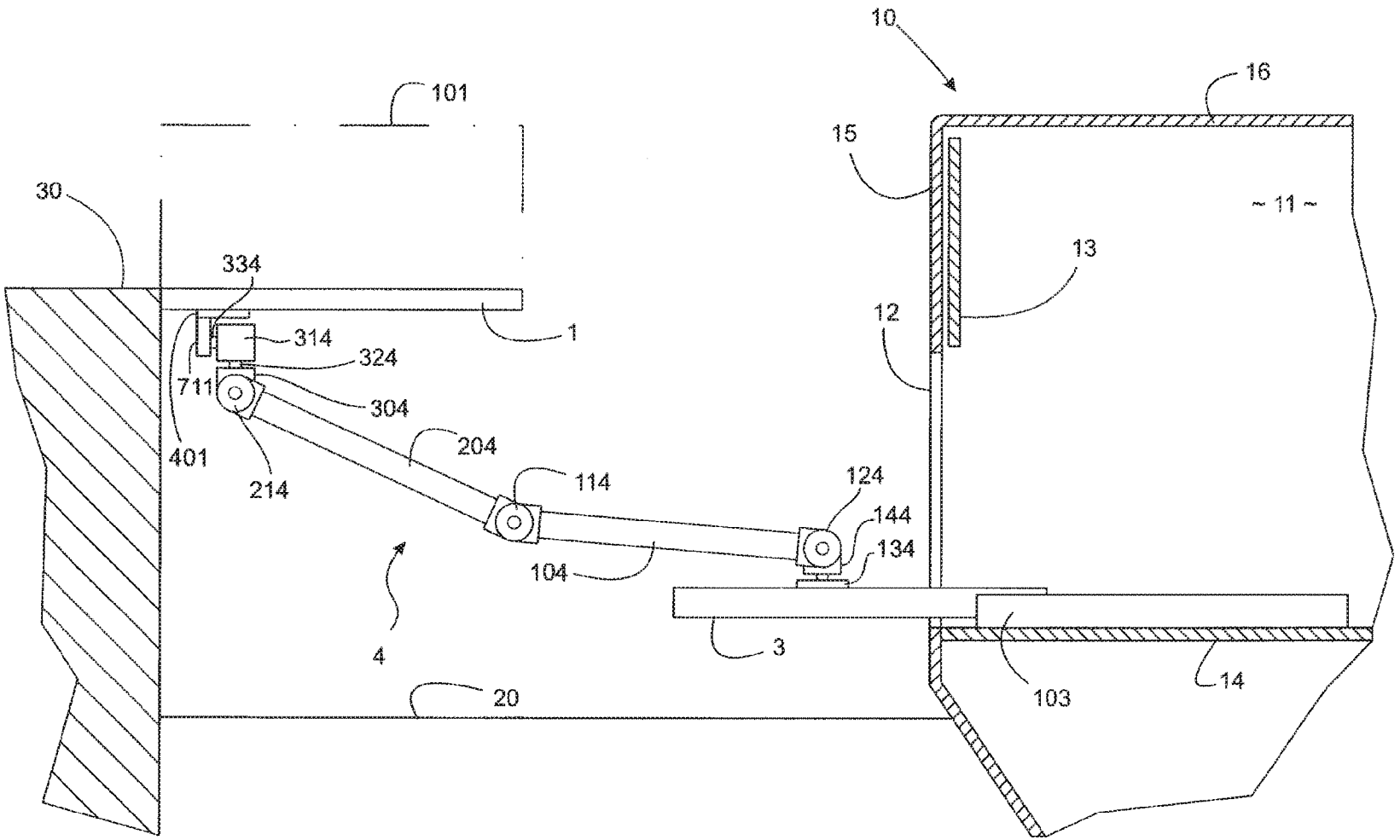
FIG. 2 is a view similar to that of FIG. 1 but with the embodiment of the apparatus illustrated in an operating configuration.

In FIG. 2 there is illustrated the same apparatus as in FIG. 1 but in an operating configuration, in which the platform 1 has been moved into abutment with a landing pier 30.

Figure 3:
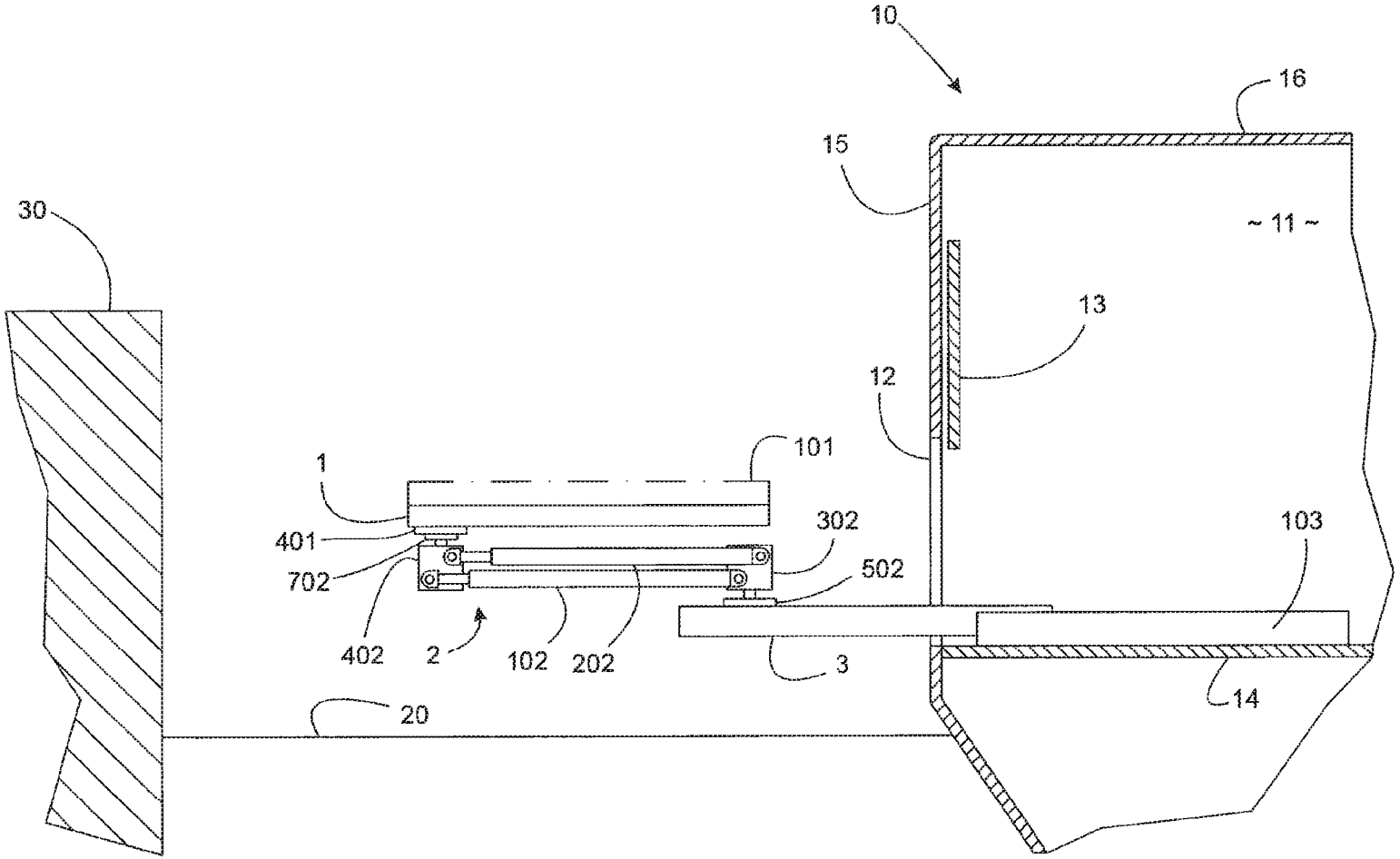
FIG. 3 is a side elevation view of a second embodiment of the apparatus according to the present invention when in a non-operating configuration.

In FIG. 3 there is illustrated a second embodiment of the apparatus according to the present invention. In the figure, like parts illustrated in the previous pages are referred to by like numerals.

Similarly to what described for the previous embodiment, a guide 103 adapted to movably and slidably receive a support base 3 is located on a deck 14 inside the compartment 11. In the embodiment described herein, said support base 3 has arranged thereon a foot 502 of the movement assembly 2 of the apparatus according to the present invention, which foot is also slidable as will be better seen from FIG. 4 described hereinbelow; said foot comprises a drive means which allows said movement assembly to be rotated with respect to an axis perpendicular to the plane of said support base. This movement assembly comprises a first box-like body 302, rotating with respect to an axis perpendicular to the plane of the support base 3, connected with two pairs of pistons, for example hydraulic pistons 102 and 202, of which only one can be seen in the Figure for each pair, said pairs of pistons being connected at one end to said first box-like body 302 and at the opposite end to a second box-like body 402. A block 702 of the movement assembly 2 is rotatably connected to said second box-like body 402 and coupled to the platform 1 as better described hereinbelow. The support base 3 appears to protrude in cantilever fashion out of the transom 15, well above the water line 20 and facing towards a landing pier 30.

Figure 4:
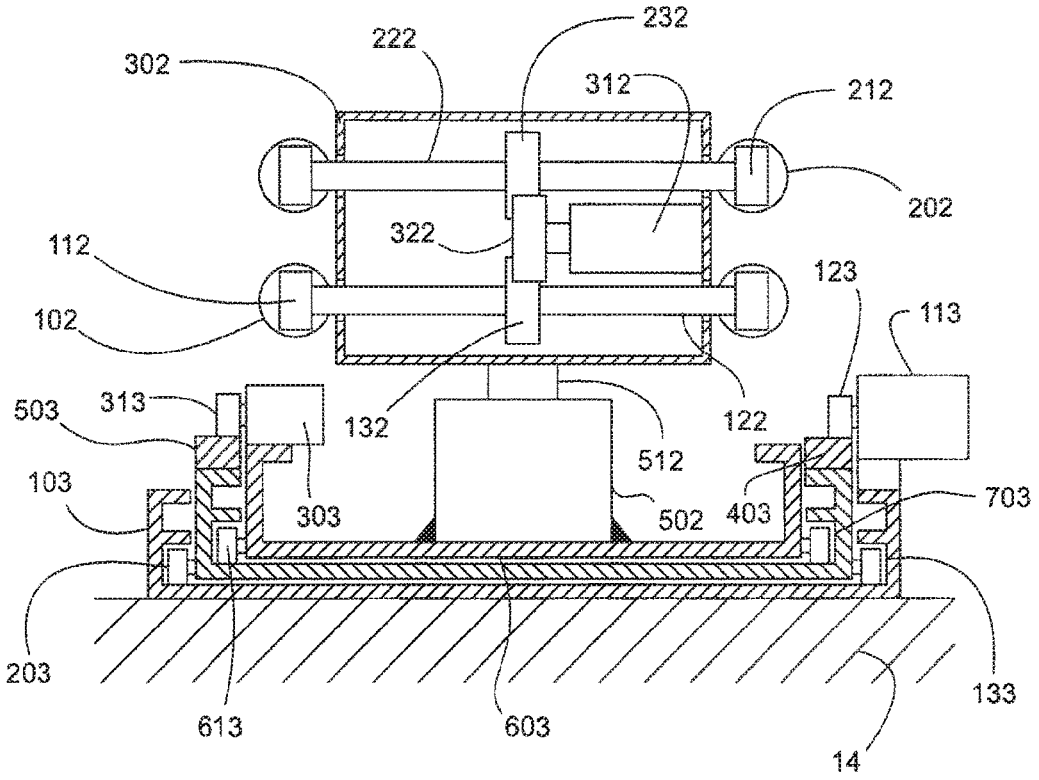
FIG. 4 is an enlarged detail of FIG. 3 with parts in section.

In FIG. 4 there is shown an enlarged detail of FIG. 3 with parts in section. As can be seen from the Figure, the pairs of pistons 102, 202 are respectively connected to each other via respective shafts 122, 222 which are fixedly coupled to fasteners 112, 212 arranged at the ends of said pistons 102, 202. Each of said shafts 122, 222 has keyed thereto a sprocket wheel 132, 232 cooperating with a sprocket wheel 322 of an engine 312; the shafts 122, 222 and the engine 312 are accommodated within the box-like body 302.

The box-like body 302 is mounted to a shaft 512 received in an engine 502 which constitutes the foot of the movement assembly 2. Such an engine 502 is arranged on a carriage 603 which is movably mounted within the support base 3 both by means of wheels 613 sliding along shaped grooves 703 of the base 3, and by means of an engine 303 whose sprocket wheel 313 cooperates with a rack 503 arranged on a side trailing edge of said support base 3.

On the opposite side edge of the base 3 there is provided a rack 403 cooperating with a sprocket wheel 123 of an engine 113 which, in turn, is positioned on a side of the guide 103; said guide is located on the deck 14 of the vessel 10. The cooperation of the rack 403 with the engine 113 allows the support base 3, which is provided with wheels 203 cooperating with shaped grooves 133 of the guide 103, to be moved.

Figure 5:
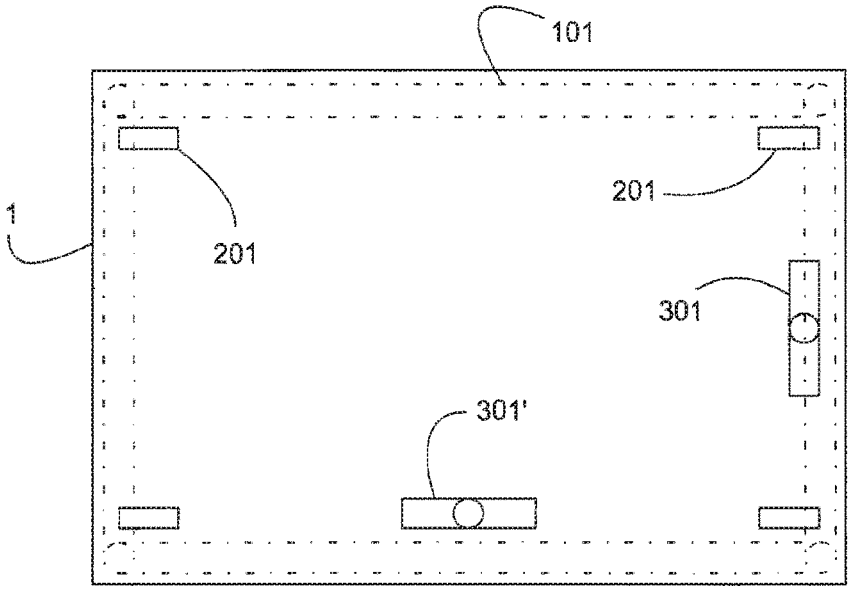
FIG. 5 is a top plan view of the platform of the apparatus according to the present invention.

In FIG. 5 there is illustrated a plan view of the platform 1 of the apparatus according to the present invention. Said platform 1 is provided with movable shoulders 101 as illustrated by chain lines in the Figure; the platform 1 has arranged thereon proximity sensors 201 which allow the position of the platform to be detected and adjusted as appropriate, and inclinometers 301 and 301' to monitor changes in inclination of the platform with respect to the reference horizontal plane, i.e. a plane parallel to the plane of the decks of the vessel 10.

Figure 6:
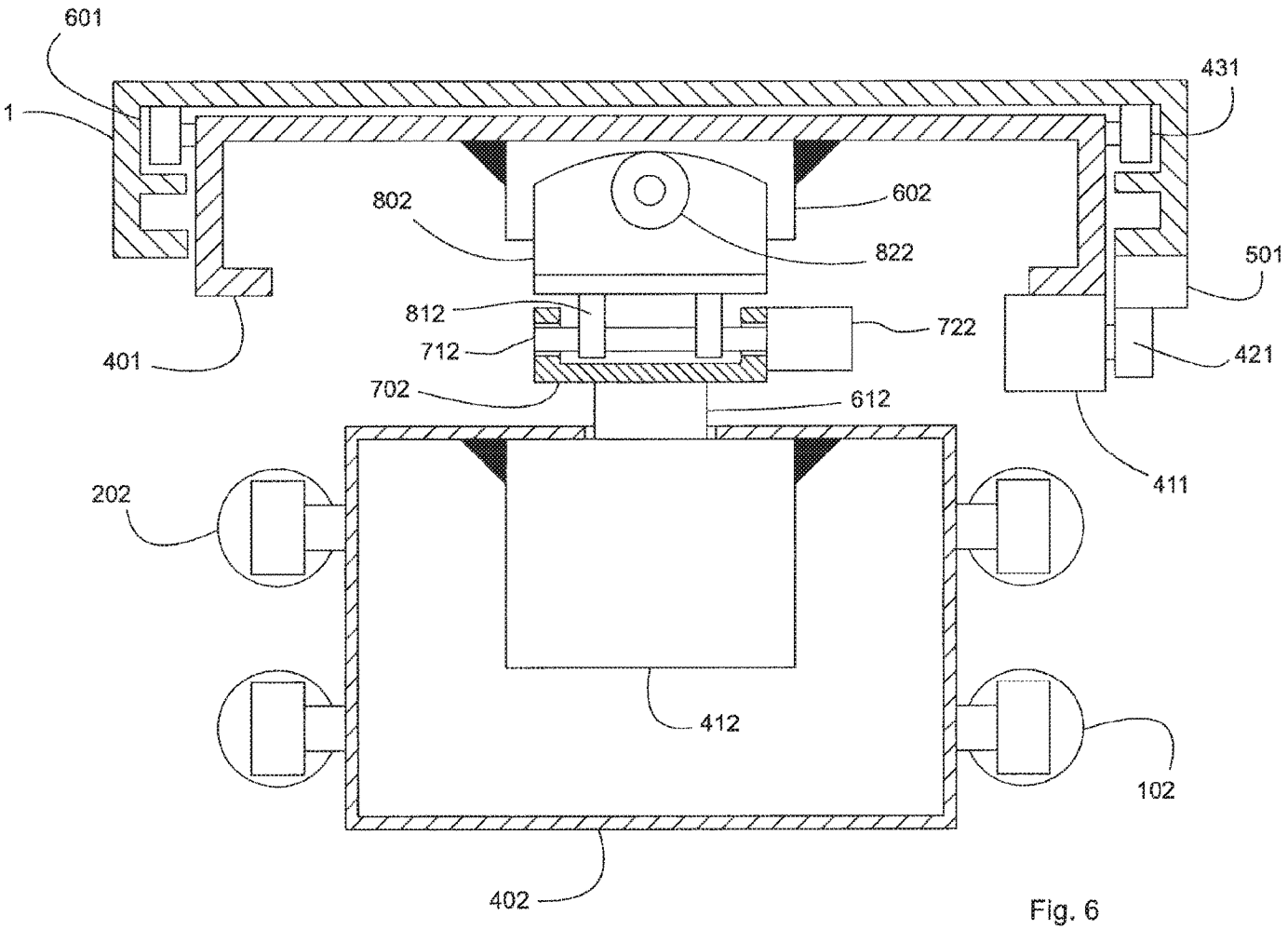
FIG. 6 is an enlarged section detail of the platform and of the relevant movable carriage as depicted in FIG. 3.

In FIG. 6 there is shown an enlarged detail of FIG. 3 with parts in section. The head 602 of the movement assembly 2 is attached to the carriage 401 which is movable with respect to the platform due to the cooperation of the rack 501, located on the trailing edge of the platform 1, with the sprocket wheel 421 of the engine 411 located on said carriage 401; the wheels 431 sliding along the grooves 601 formed in the inner wall of the platform allow such a movement to be guided as appropriate. The head 602 is pivotally coupled, with respect to an axis parallel to the longitudinal axis of the platform, to a block 802 which is provided with drive means 822. Flaps 812 protruding from the block 802 are pivotally connected, with respect to an axis parallel to the transverse axis of the platform, to a shaft 712 of an engine 722 received in a block 702, which is in turn arranged on a shaft 612 of an engine 412 located within the box-like body 402 to which the ends of the pistons 102, 202 are connected.

Figure 7:
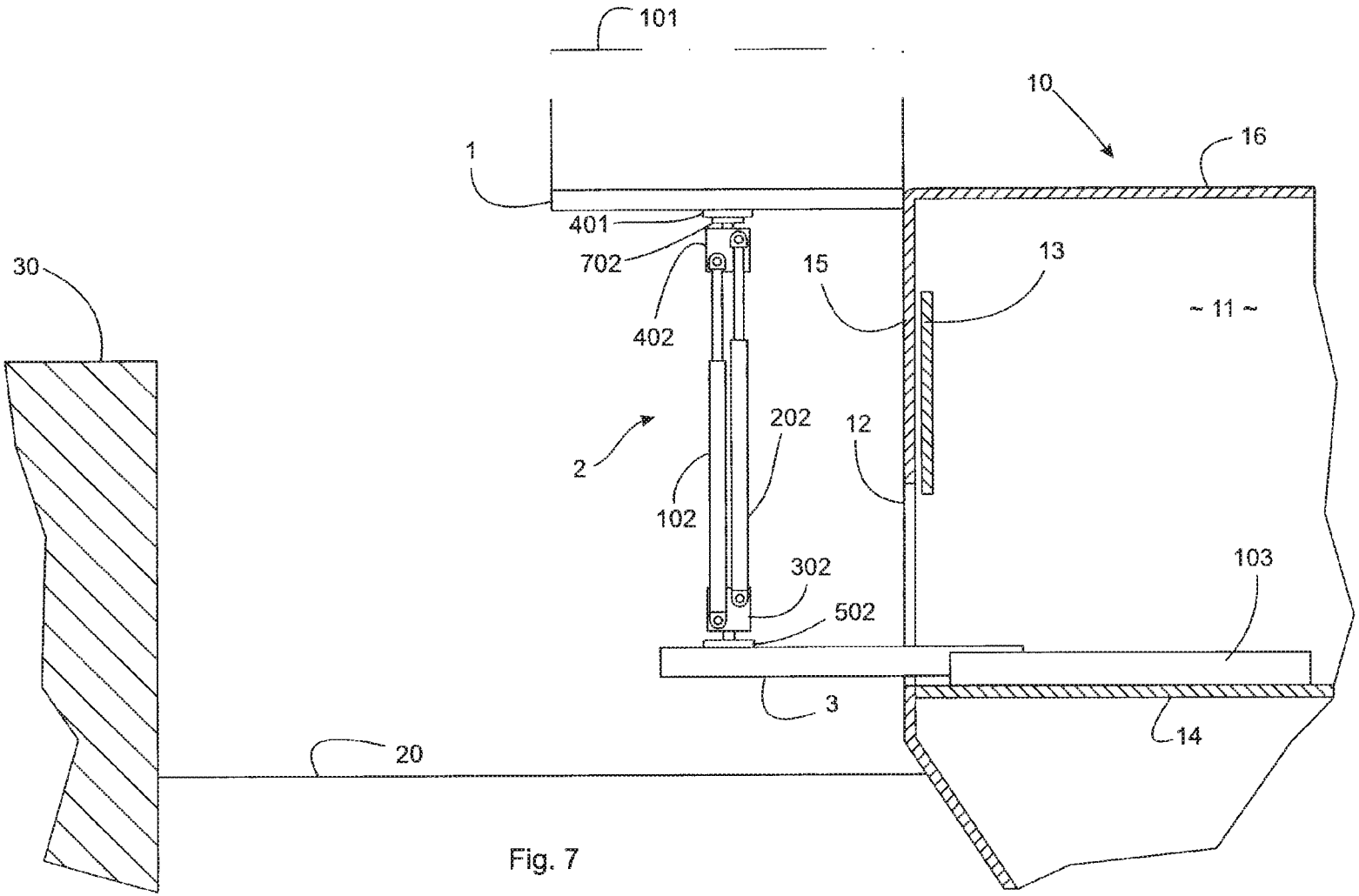
FIGS. 7 and 8 illustrate two main operational steps of the operation of the second embodiment of the apparatus according to the present invention.
Figure 8:
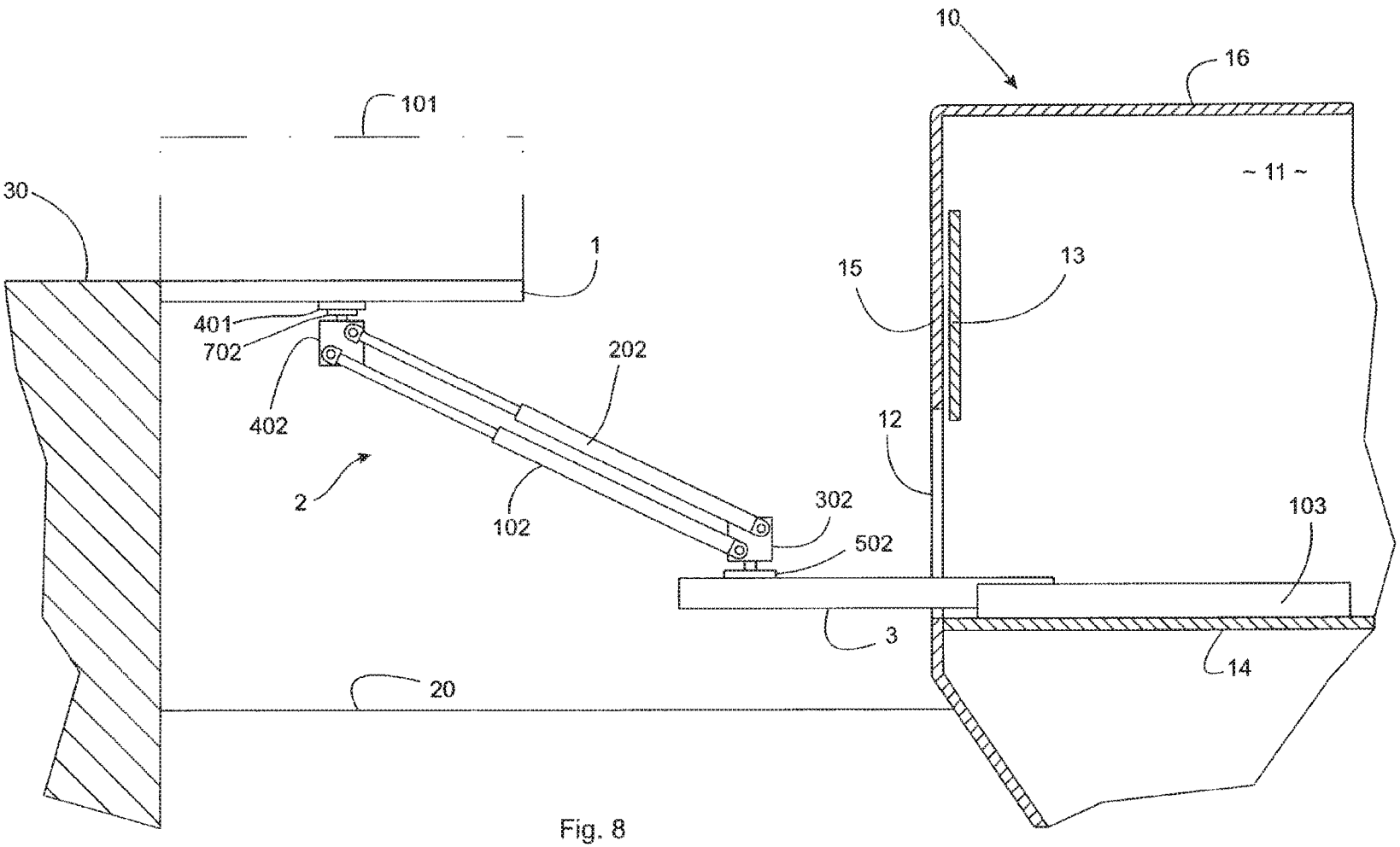

In FIGS. 7 and 8 there are shown two sequential operational steps of the first embodiment of the apparatus according to the present invention, in which Figures like parts are referred to by like numerals as set out in the above-described FIG. 3.

The operation of the apparatus according to the present invention, with particular reference to the first embodiment illustrated in FIGS. 1 and 2 and previously described, will become apparent from the following. In this case, the apparatus is initially positioned within the compartment 11 formed in the aft of the vessel 10, and the support base should be initially pulled out up to protrude in a cantilever fashion from the opening 12 in the transom 15, in a way similar to that described below for the embodiment illustrated in FIGS. 3÷ 8.

At this time, the robotic arm 4 can be deployed and moved to the position illustrated in FIG. 2 by operating the drive means 124, 114 and 214.

Here, the platform is positioned at the same height as the landing pier 30; its inclination with respect to the water line of the vessel is adjusted by controlling the operation of both the drive means 214 and the shaft 334 which is rigidly connected to the bracket 711, the bracket being integral with the carriage 401 located within the platform 1 at the base thereof. The central control unit, based on the data continuously detected by the inclinometers 301, 301' for the inclination of the platform, will transmit an appropriate command in such a way as to maintain a substantially constant attitude of the platform by operating the wrist 304.

Subsequently, the platform is moved into abutment against the upper deck, for example, or against any other location in the vessel which can be accessed by moving the robotic arm 4.

The operation of the apparatus according to the present invention, with particular reference to the second embodiment illustrated in FIGS. 3÷ 8 and previously described, will become apparent from the following.

In FIG. 3, when the apparatus is started to function, the base 3 has been extracted from its housing within the compartment 11 formed in the aft of the vessel 10 and, to this aim, the door 13 of the transom 15 has been opened so as to enable the base 3 to protrude in cantilever fashion with respect to the transom itself as in the first embodiment. Once the engine 113 has been operated to move the base 3, the engine 303 is also operated to move the carriage 603, thereby allowing the foot 502 to be moved along the base 3 itself (see FIG. 4).

In FIG. 7, the pistons 102, 202 have been rotated with respect to the axis perpendicular to their plane and extended by means of the engine 312 (see FIG. 4) in such a way that the platform 1 is at the same height as the upper deck 16. In this condition, the movable shoulders 101 of the platform have been appropriately raised up to provide an appropriate protection. During the transition from the initial position illustrated in FIG. 3 to that illustrated in FIG. 7, the platform has been maintained at an inclination substantially parallel to the water line of the vessel by operating the engines 822 and 722 as illustrated in FIG. 6 and described above. When the platform 1 is positioned at the same height as the upper deck, the passengers and/or goods to be landed can be loaded onto the platform 1.

In the next step, as illustrated in FIG. 8, the platform 1 is moved into abutment with the landing pier 30; the pistons 102, 202 are extended up to allow the platform 1 to reach the landing pier 30 and to be flush therewith. To this aim, the inclination of the platform 1 is monitored again by the inclinometers 301, 301' and changed by operating the engines 722, 822.

Of course, all the drive means involved, i.e. the engine 113 which controls the movement of the support base 3, the engine 303 of the carriage 603 having arranged thereon the foot 502, the engine of the foot 502 which allows the foot to be rotated with respect to a vertical axis of the movement assembly 2, the engine 412 which allows the platform 1 to be rotated, the engine which moves the carriage 401 having arranged thereon the head 602 of the movement assembly, and the engines 722, 822 which control the inclination of the platform, as well as the pistons 102, 202, are advantageously coupled to a central control unit which allows the operation to be appropriately managed according to preset programs, i.e. according to controls which are manually operated via a suitable user interface.

In the two embodiments described herein and illustrated in the accompanying drawings, there is shown a landing pier 30 to which the vessel 10 is facing with its transom 15. However, the ultimate versatility in movement of both the movement assembly (4; 2) and the platform 1 allows the landing pier to be approached even when the vessel is positioned along one of the edges. Furthermore, the apparatus according to the present invention can be conveniently used not only for loading/unloading from/to land-side, but also for transferring to other vessels, such as a diving board or platform, or for transferring objects or individuals between different decks of the vessel.

The approach of using a robotic arm 4 as a movement assembly to move the platform has several advantages both in terms of easiness of manufacture and in terms of versatility of use and adaptability to different kinds of vessels.

Advantageously, the segments 104, 204 of the robotic arm 4 can be variable in length, such as for example the pistons 102, 202 illustrated in FIGS. 1, 5 and 6 in connection with the previously described embodiment.

The engines employed in both the embodiments of the apparatus according to the present invention may be servomotors, electric engines, pneumatic engines, hydraulic engines, or other similar drive means.

The central control unit, not shown in the Figure, may also be located remote from the apparatus according to the present invention, and a control panel may be also provided on board the platform itself, i.e. there may be provided either a remote control or a remote control application operating on portable devices, such as smart-phones or the like. The central control unit is also interfaced with inclinometers 301, 301' to detect changes in inclination of the platform 1 and transmit an appropriate inclination-adjustment instruction to the wrist 304 and/or the engines 722, 822 so as to ensure that the platform is positioned parallel to the water line of the vessel.

Similarly, the proximity sensors 201 arranged at the four corners of the platform 1 are connected to said control unit in order to allow the platform 1 to be appropriately positioned with respect to either the landing pier 30 or the upper deck 16 of the vessel 10 or other positions as desired.

Therefore, the apparatus according to the present invention provides a solution which is highly reliable, versatile, reduced in size when in a non-operating condition, and also provided with excellent safety features.

The invention claimed is:

1. Apparatus for transferring people to or from a vessel (10), comprising a movable platform (1), able to carry people, connected to a movement assembly (4;2), said movement assembly (4;2) being arranged on a support base (3) which is coupled to said vessel (10), said platform (1) being maintained at an inclination substantially parallel to a water line of said vessel (10) by suitable means (301, 301', 304, 722, 822) comprising inclinometers, the movement assembly (4;2) being fully retractable from an operating and deployed condition to a non-operating and retracted condition, an overall volume of the non-operating and retracted condition being sensibly lower than that of the operating and deployed condition, wherein said support base (3) is coupled to said vessel (10) and arranged parallel with respect to planes of decks (14) of said vessel (10), and wherein said movement assembly comprises an articulated arm (4) provided with at least two segments (104, 204, 304) which can pivot with respect to each other and with respect to both said platform (1) and said support base (3), there being provided suitable drive means (114, 124, 214, 314), comprising shafts.

2. Apparatus according to claim 1, wherein said movement assembly (4;2) is arranged on said support base (3) in such a way as to rotate by 360° about an axis which is perpendicular to said base, the movement assembly being provided with suitable drive means (134; 502).

3. Apparatus according to claim 1, wherein said platform (1) is mounted to said movement assembly (4;2) in such a way as to rotate by 360° about an axis which is perpendicular to said platform, there being provided suitable drive means (324; 412).

4. Apparatus according claim 1, wherein said platform (1) is mounted to a movable carriage (701; 401) along a direction parallel to a plane of said platform (1), the movable carriage being in turn rotatably coupled to said movement assembly (4;2).

5. Apparatus according to claim 1, wherein said articulated arm is a robotic arm (4) comprising two articulated arms (104, 204) and a wrist (304) which is pivotally connected to a free end of one (204) of said two segments (104, 204), said wrist (304) being connected to the movable carriage of the platform (1).

6. Apparatus according to claim 5, wherein the free end (314) of said wrist (304) can be rotated by suitable drive means with respect to two axes which are perpendicular to each other.

7. Apparatus according to claim 1, wherein said articulated segments (104, 204) can be variable in length.

8. Apparatus according to claim 1, further comprising a central control unit which is operatively interfaced at least with said movement assembly (2) and with said means for maintaining the inclination of said platform (1), there being provided user interface means to cooperate with said central control unit.

9. Apparatus according to claim 8, wherein there are provided one or more proximity sensors (201) arranged on said platform (1) and connected to said central control unit.

* * * * *